United States Patent [19]

Kunikane et al.

[11] 4,359,730

[45] Nov. 16, 1982

[54] ALPHANUMERIC DISPLAY CONTROLLED BY MICROPROCESSOR

[75] Inventors: Akihiko Kunikane; Shintaro Hashimoto, both of Ikoma; Satoshi Teramura, Kashihara; Kunihiro Kobayashi, Nara; Tetsuo Iwase, Nara, all of Japan

[73] Assignee: Sharp Kabushiki Kaisha, Osaka, Japan

[21] Appl. No.: 202,704

[22] Filed: Oct. 30, 1980

[30] Foreign Application Priority Data

Oct. 30, 1979 [JP] Japan ..... 54-140788

[51] Int. Cl.[3] ..... G09G 3/04

[52] U.S. Cl. ..... 340/792; 340/711

[58] Field of Search ..... 340/711, 726, 792

[56] References Cited

U.S. PATENT DOCUMENTS 3,786,475 1/1974 Staar ..... 340/711

3,932,859 1/1976 Kyriakides et al. ..... 340/711

3,938,139 2/1976 Day ..... 340/809

4,205,312 5/1980 Nelson ..... 340/792

*Primary Examiner*—David L. Trafton

*Attorney, Agent, or Firm*—Birch, Stewart, Kolasch & Birch

[57] ABSTRACT

There is disclosed an information display system for displaying information. Information such as an English sentence "May I ask you to post this letter?" is first stored word by word in a first memory means. "May I ask you to post" is fetched from the first memory means and loaded into a second memory means for displaying the same on a display panel. After a predetermined period of time has gone on, the display is shifted by the number of characters in the next succeeding word to be displayed, i.e., four characters in "this" to establish a length of blank digits necessary for displaying "this". Subsequent to the shift operation the blank digits of a display panel is filled with "this". The process continues on a word for word basis until the complete sentence has been displayed.

4 Claims, 17 Drawing Figures

FIG. 8

| | |
|---|---|
| (1) | MAY I ASK YOU TO POST |
| (2) | ASK YOU TO POST |
| (3) | ASK YOU TO POST THIS |
| (4) | U TO POST THIS |
| (5) | U TO POST THIS LETTER |
| (6) | TO POST THIS LETTER |
| (7) | TO POST THIS LETTER ? |

FIG. 13

| | |
|---|---|
| (1) | MAY I ASK YOU TO POST |
| (2) | ASK YOU TO POST |
| (3) | ASK YOU TO POST T |
| (4) | ASK YOU TO POST TH |
| (5) | ASK YOU TO POST THI |
| (6) | ASK YOU TO POST THIS |
| (7) | U TO POST THIS |
| (8) | U TO POST THIS L |
| (9) | U TO POST THIS LE |

ALPHANUMERIC DISPLAY CONTROLLED BY MICROPROCESSOR

BACKGROUND OF THE INVENTION

This invention relates to an information display system and more particularly to a display device for performing a new and unique display operation in an electronic dictionary and the like.

It is very convenient if information represented by one or more English sentences or one or more Japanese sentences are displayed in an easy-reading manner in an electronic dictionary or the like. The assignee of this application has proposed one approach in our copending application Ser. No. 058,666 "DISPLAY DEVICE FOR ELECTRONIC CALCULATORS OR THE LIKE" filed on July 18, 1979 and now U.S. Pat. No. 4,298,865, wherein a visual display of a display panel is shifted digit by digit every given period of time. However, more attractive methods for displaying information on a display panel of a limited digit capacity appear possible.

Accordingly, it is an object of the present invention to provide a new display system different from the conventional manner.

In summary, according to the present invention, information such as an English sentence "May I ask you to post this letter?" is first stored word by word in a first memory means. "May I ask you to post" is fetched from the first memory means and loaded into a second memory means for displaying the same on a display panel. After a predetermined period of time has gone on, the display is shifted by the number of characters in the next succeeding word to be displayed, i.e., four characters in "this" to establish a length of blank digits necessary for displaying "this". Subsequent to the shift operation the blank digits of the display panel are filled with "this".

BRIEF DESCRIPTION OF THE DRAWINGS

For a more complete understanding of the present invention and for further objects and advantages thereof, reference is now made to the following description taken in conjunction with the accompanying drawings, in which:

FIG. 8 is a view showing a sequence of information display mode according to the present invention;

FIG. 13 is a view showing a sequence of information display mode according to another preferred embodiment of the present invention.

DETAILED DESCRIPTION OF THE INVENTION

Figure 1:
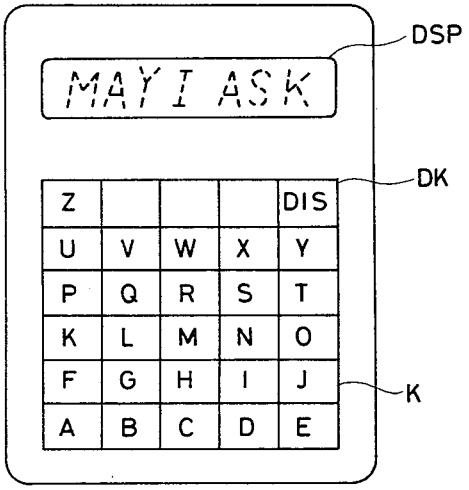
FIG. 1 is a schematic view of a programmable calculator according to one preferred form of the present invention.

FIG. 1 shows the appearance of a programmable calculator equipped with a display panel constructed according to one preferred embodiment of the present invention, wherein the display panel DSP is typically a 21-digit dot matrix display panel or a segmented display panel. A keyboard K has a plurality of alphabet keys A–Z through which information to be displayed is introduced. Upon actuation of a display key DIS the information introduced via the keyboard K is displayed on the display panel DSP.

Figure 2:
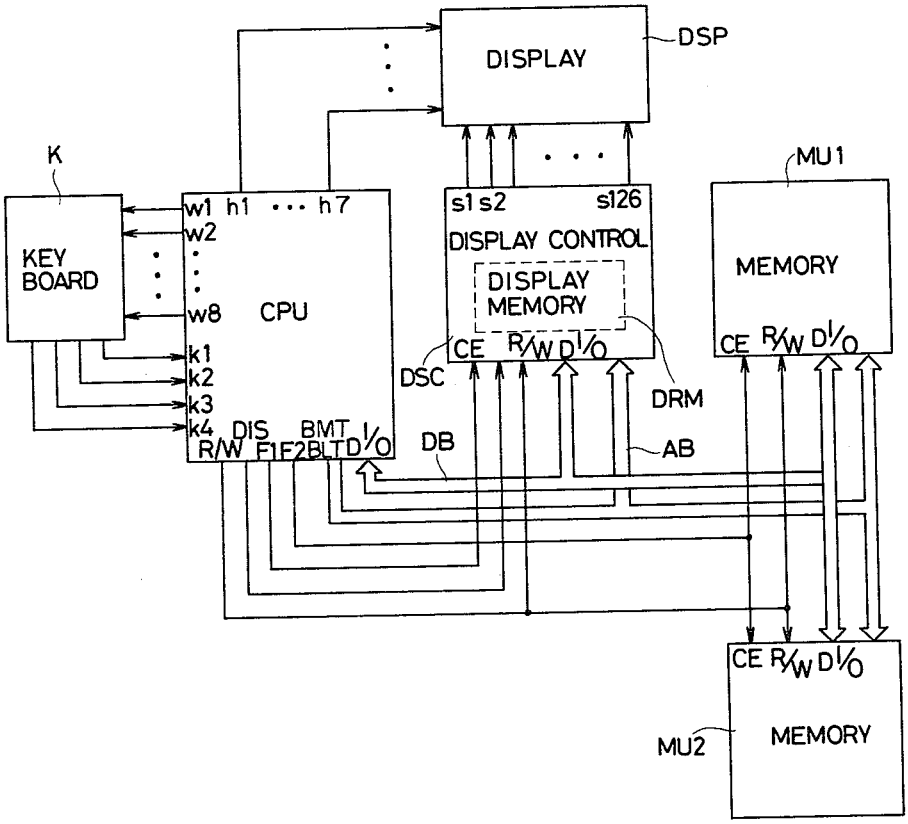
FIG. 2 is a block diagram of an internal arrangement of the calculator of FIG. 1.
Figure 2:
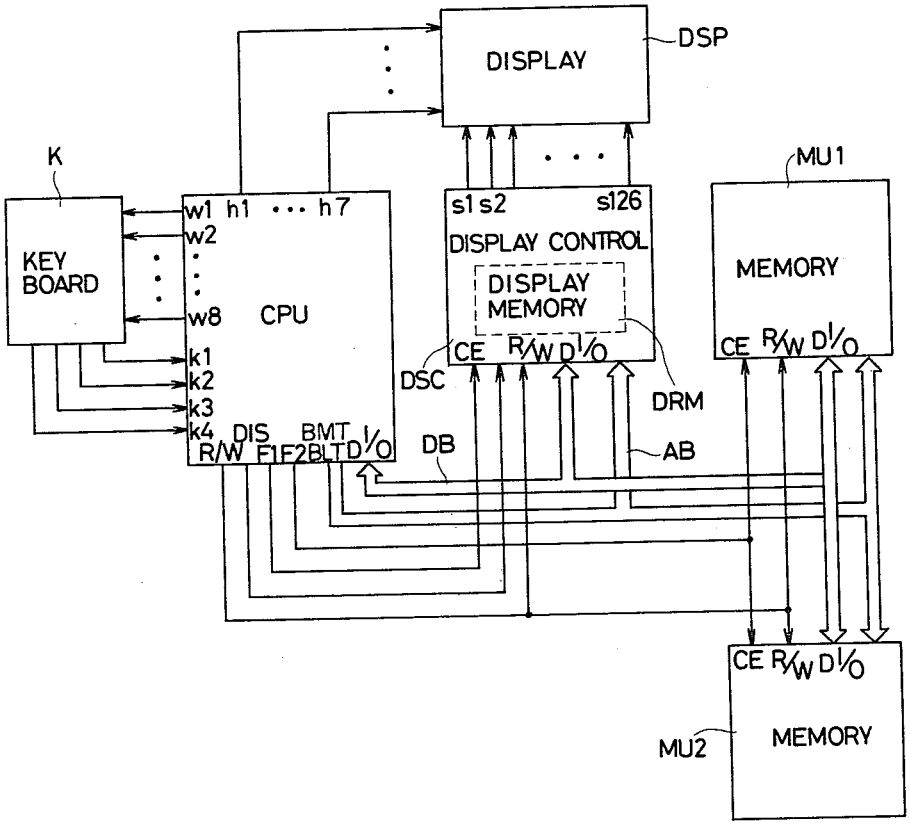

FIG. 2 is a schematic block diagram of the calculator shown in FIG. 1. A central processor unit (CPU) includes a random access memory RAM for data storage and a read only memory for program storage. The keyboard K is operatively connected to key strobe output terminals $w_1$–$w_8$ and key input terminals $k_1$–$k_4$ of the CPU. The display panel DSP on the other hand is connected to opposite electrode signal output terminals $h_1$–$h_7$. Operatively associated with the CPU are a display control circuit DSC and a pair of external memories $MU_1$ and $MU_2$ both serving as a first memory means. The display control circuit DSC may be implemented with a conventional random access memory having a display data storage DRM. The display control circuit DSC is connected to the CPU via a read/write signal terminal R/W, a display/disable control signal output terminal DIS, a memory digit address output terminal $B_LT$, a memory file address output terminal $B_MT$, an address bus AB and a data bus DB.

Figure 3:
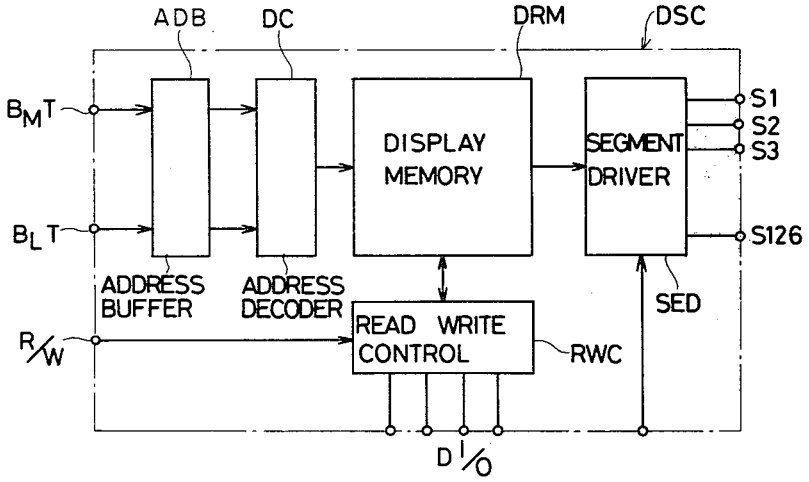
FIG. 3 is a block diagram showing details of a display control contained in FIG. 2.

The display control circuit DSC included in FIG. 3, is best shown in FIG. 2, wherein the display data storage DRM is connected to an address decoder DC which decodes information sent from the memory digit address output terminal $B_LT$ and the memory digit address output terminal $B_MT$ of the central processor unit CPU via an address buffer ADB. A read/write control circuit RWC allows information to be read from or written in the display data storage DRM via the data input and output terminals DI/O in response to a read/write signal from the read/write terminal R/W. The contents of the display data storage DRM are supplied to and decoded by a segment driver SED. The display data appear at the output terminals $S_1$–$S_{126}$. The segment driver SED delivers enable waveform signals to enable the display panel DSP when the display/disable control signal DIS assumes a logic "1" level, and disable waveform signals to disable the display panel DSP when the said control signal assumes a logic "0" level.

Figure 4A:
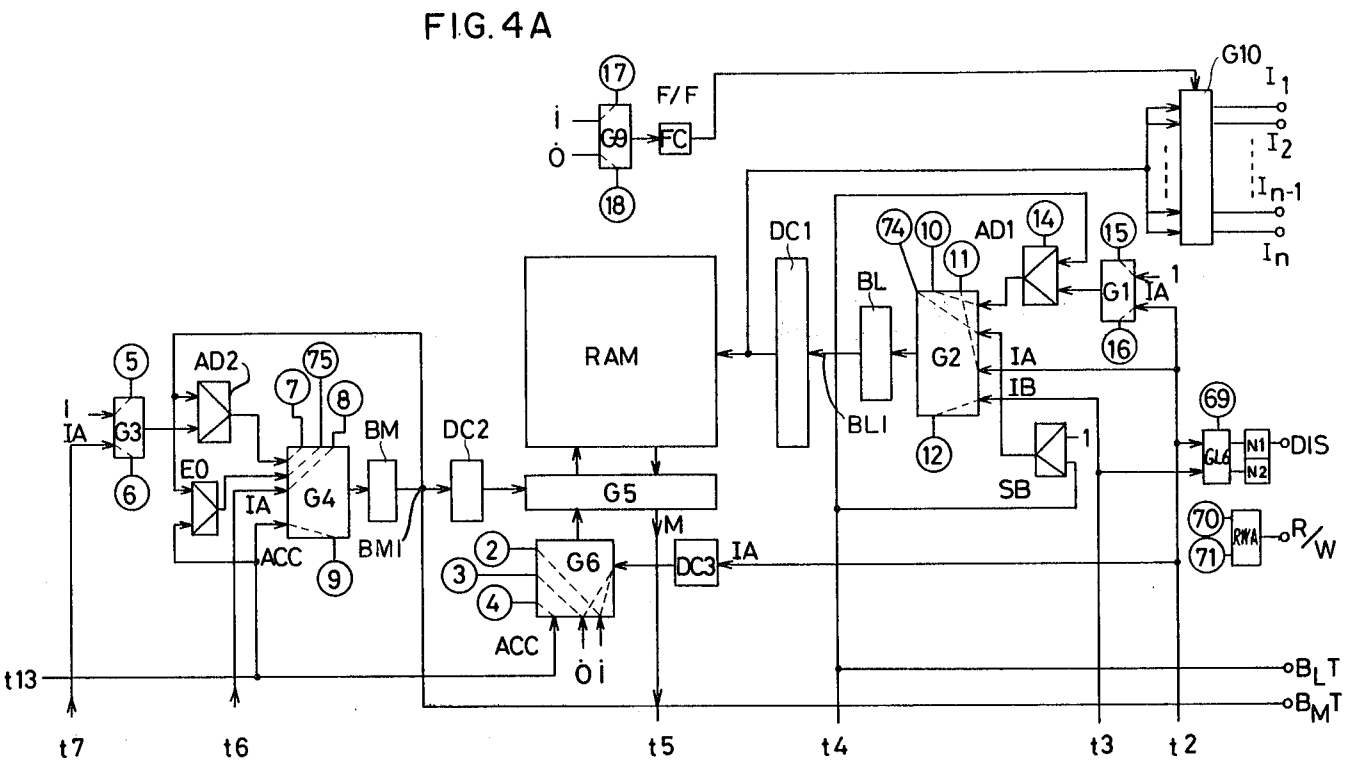
FIGS. 4A through 4D are schematic block diagrams of a typical central processor unit (CPU)
Figure 4B:
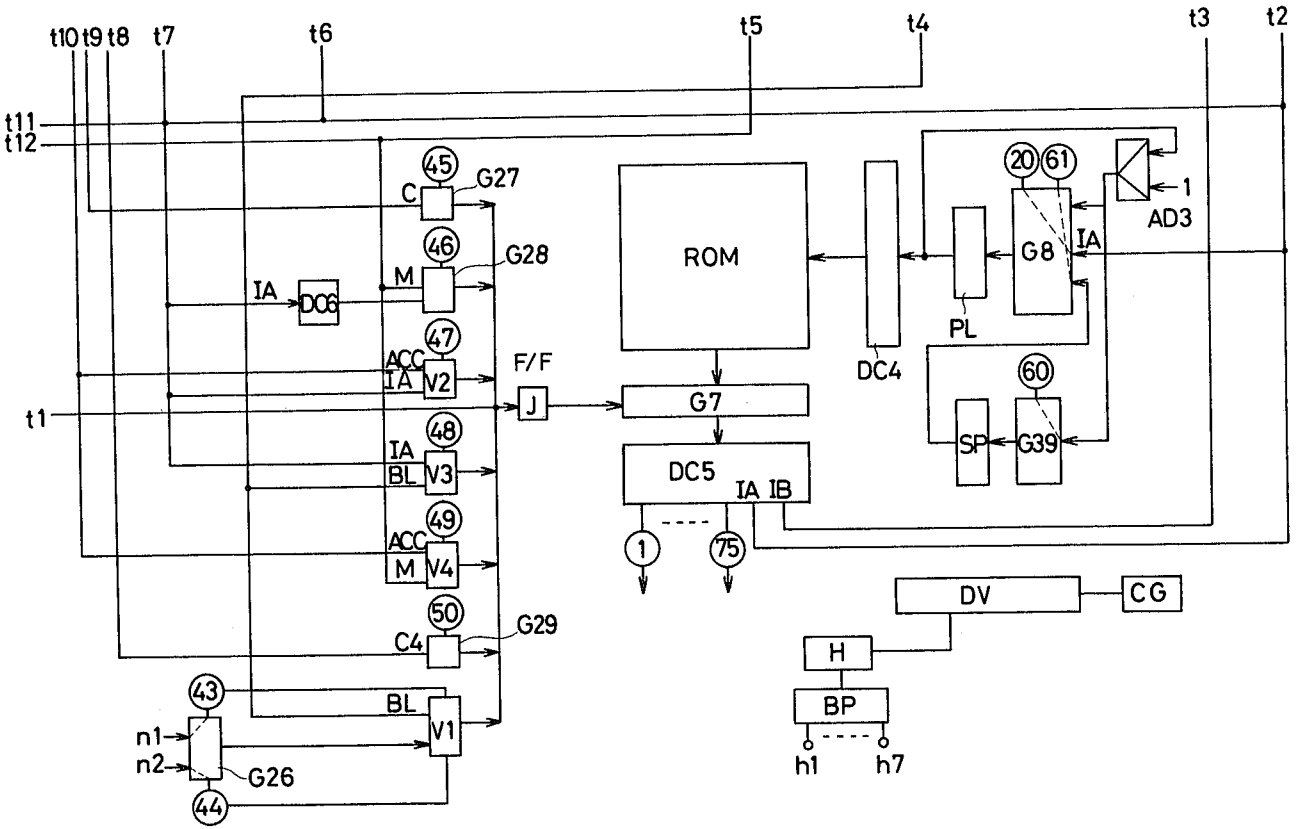
Figure 4C:
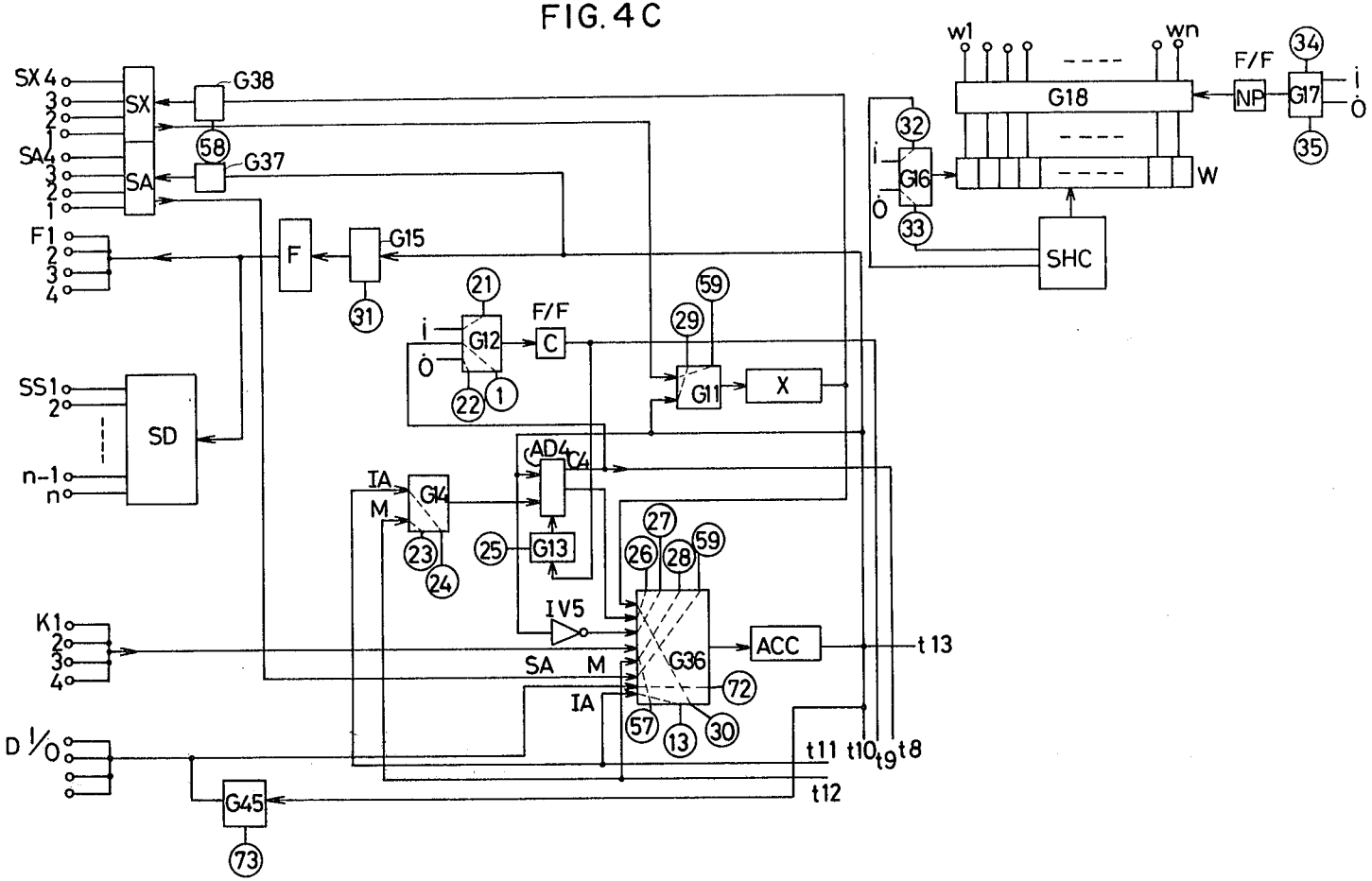
Figure 4D:
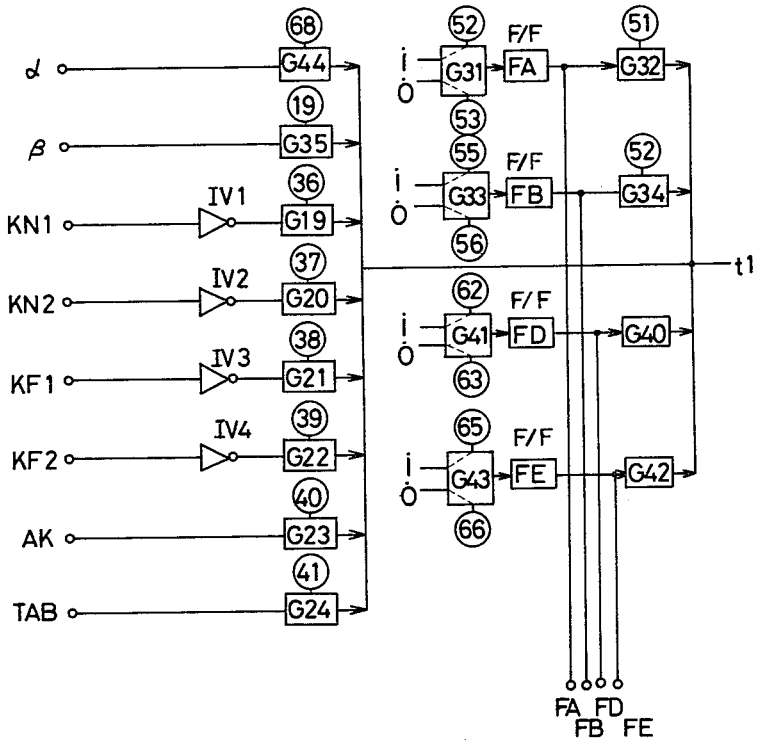
Figure 5:
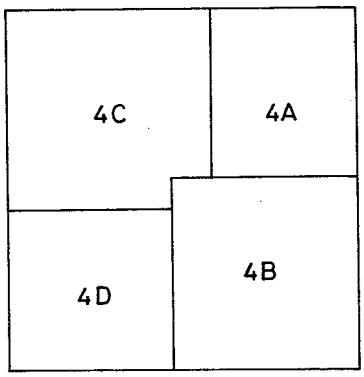
FIG. 5 is an equivalent circuit diagram of the CPU of FIGS. 4A through 4D.

FIG. 5, a composite diagram of FIGS. 4A–4D, shows a logic wiring diagram of a typical example of the CPU scheme in the calculator whereby the display operation of the present invention is effected. It is understood that the illustrated CPU architecture is designed for general purposes and some of its functions are not concerned with the present invention.

[CPU ARCHITECTURE]

Referring to FIG. 4A, a random access memory RAM is of a 4 bit input and output capacity and accessible to any specific input digit position thereof as identified by a digit address and a file address. The RAM includes a digit address counter with its output terminal BL1, a digit address decoder $DC_1$, a file address counter BM with its output terminal BM1, a file address decoder $DC_2$ and an adder $AD_1$ which serves as an adder and a subtractor respectively in the absence and presence of a control instruction 14. It further includes a second adder $AD_2$ and a gate $G_1$ for providing either a digit "1" or an operand $I_A$ to an input to the adder/subtractor $AD_1$ and delivering 1 or $I_A$ when a control instruction 15 or 16 is developed, respectively. The memory digit address counter BL has a countdown circuit SB. An input gate $G_2$ is provided for the memory digit address counter BL, which enables the output of the adder/subtractor $AD_1$, the operand $I_A$, the other operand $I_B$ and the output of the countdown circuit SB to pass therethrough respectively when control instruction 10, 11, 12 and 74 are developed. A gate $G_3$ is disposed to provide a digit "1" or the operand $I_A$ to an input to the adder/subtractor $AD_2$, the former being provided upon the development of an instruction 5 and the latter upon the development of an instruction 6. A circuit EO supplies to a gate $G_4$ an exclusive OR sum of the both counts of the memory file address counter BM and the accumulator ACC. The gate $G_4$ is an input gate to the memory file address BM which enables the output of the adder $AD_2$, the operand $I_A$, the contents of an accumulator ACC and the output of EO to pass upon the development of instructions 7, 8, 9 and 75. A file selection gate $G_5$ is further provided for the memory RAM. A decoder $DC_3$ translates the operand $I_A$ and supplies a gate $G_6$ with a desired bit specifying signal. The gate $G_6$ is an input gate to the memory RAM and contains a circuit arrangement for introducing a binary code "1" into a specific bit position of the memory RAM identified by the operand decoder $DC_3$ and a binary code "0" into a specific bit position of the memory RAM identified by $DC_3$, respectively, when a control instruction 2 or 3 is developed. Upon the development of an instruction 4 the contents of the accumulator ACC are read out. There are further provided display controlling flags $N_1$ and $N_2$. An input gate $G_{46}$ to $N_1$ and $N_2$ is enabled with 69. A read/write circuit RWA with an output terminal R/W directs read and write operations in response to 70 and 71, respectively.

Referring to FIG. 4B, in conjunction with FIG. 4A, a read only memory ROM has its associated program counter PL which specifies a desired step in the read only memory ROM. The read only memory ROM further contains a step access decoder $DC_4$ and an output gate $G_7$ which shuts off transmission of the output of the ROM to an instruction decoder $DC_5$ when a judge flip flop (F/F) J is set. The instruction decoder $DC_5$ is adapted to decode instruction codes derived from the ROM and divide them into an operation code area $I_O$ and operand areas $I_A$ and $I_B$, the operation code being decoded into any one of the control instructions 1–75. The decoder $DC_5$ is further adapted to output the operand $I_A$ or $I_B$ as it is when sensing an operation code accompanied by an operand. An adder $AD_3$ increments the contents of the program counter PL by one. An input gate $G_8$ associated with the program counter PL provides the operand $I_A$ and transmits the contents of a program stack register SP when the instructions 20 and 61 are developed, respectively. When the instructions 20, 61 and 60 are being processed, any output of the adder $AD_3$ is not transmitted. Otherwise the $AD_3$ output is transmitted to automatically load "1" into the contents of the program counter PL. A flag flip flop FC has an input gate $G_9$ therefor which introduces binary codes "1" and "0" into the flag flip flop FC when the instructions 17 and 18 are developed, respectively. A key signal generating gate $G_{10}$ provides the output of the memory digit address decoder $DC_1$ without any change when the flag F/F FC is in the reset state (0), and renders all outputs $I_1$–$I_n$ "1" whatever output $DC_1$ provides when FC is in the set state (1). There are further provided a clock generator CG, a divider DV, a displaying counter H and an opposite electrode select signal generator BP for the liquid crystal display panel with opposite electrode signal output terminals $h_1$–$h_7$. Referring to FIG. 4C, the accumulator ACC is 4 bits long and a temporary register X is also 4 bits long. An input gate $G_{11}$ for the temporary register X transmits the contents of the accumulator ACC and the stack register SX respectively upon the development of the instructions 29 and 59. Hereinafter, "F/F" and "flip-flop" are used interchangeably.

An adder $AD_4$ executes binary addition on the contents of the accumulator ACC and other data. The output $C_4$ of the adder $AD_4$ assumes "1" when the most significant bit or fourth bit binary addition yields a carry. A carry F/F C has its associated input gate $G_{12}$ which sets "1" into the carry F/F C in the presence of "1" of the fourth bit carry $C_4$ and "0" into the same in the absence of $C_4$ (0). "1" and "0" are set into F/F C upon the development of instructions 21 and 22, respectively. A carry (C) input gate $G_{13}$ enables the adder $AD_4$ to perform binary addition with a carry and thus transmits the output of the carry F/F C into the adder $AD_4$ in response to the instruction 25. An input gate $G_{14}$ is provided for the adder $AD_4$ and transfers the output of the memory RAM and the RAM and the operand $I_A$ upon the development of instructions 23 and 24, respectively. An output buffer register F has a 4 bit capacity and an input gate G15 which enables the contents of the accumulator ACC to enter into F upon the development of instruction 31. An output decoder SD decodes the contents of the output buffer F into display segment signals $SS_1$–$SS_n$. An output buffer register W has a shift circuit SHC which shifts the overall bit contents of the output buffer register W one bit to instruction the right at a time in response to 32 or 33. An input gate $G_{16}$ for the output buffer register W leads "1" and "0" into the first bit position of the said register W upon instructions 32 and 33, respectively. Immediately before "1" or "0" enters into the first bit position of the output buffer register W the output buffer shift circuit SHC becomes operative.

An output control flag F/F NP has an input gate $G_{17}$ for receiving "1" and "0" upon the development of instructions 34 and 35, respectively.

The buffer register W is provided with an output control gate $G_{18}$ for providing the respective bit outputs thereof at one time only when the output control flag F/F NP is in the set state (1). The outputs of the output buffer register W are available as key strobe signals. There are further provided a judge F/F J, (see FIG. 4B) an inverter $IV_1$ and an input gate $G_{19}$ to the judge F/F J for transferring the state of an input $KN_1$ into J upon the development of instruction 36. In the case where $KN_1=0$, $J=1$ because of intervention of the inverter $IV_1$. An input gate $G_{20}$ to the judge F/F J is adapted to transfer the state of an input $KN_2$ into J upon instruction 37. It is noted that, when $KN_2=0$, $J=1$ via the inverter $IV_2$. As input gate $G_{21}$ to the judge F/F J is adapted to transfer the state of the input $KF_1$ into J upon instruction 38. When $KF_1=0$, $J=1$ because of intervention of the inverter $IV_3$. An input gate $G_{22}$ to the judge F/F J is adapted to transfer the state of the input $KF_2$ into J upon instruction 39. When $KF_2=0$, $J=1$ because of the intervened inverter $IV_4$. An input gate $G_{23}$ is provided for the judge F/F J for transmission of the state of an input AK into J upon the development of instruction 40. When $AK=1$, $J=1$. An input gate $G_{24}$ is provided for the judge F/F J to transmit the state of an input TAB into J pursuant to instruction 41. When $TAB=1$, $J=1$. A gate $G_{28}$ is provided for setting the judge F/F J upon the development of instruction 46. A comparator $V_1$ (FIG. 4B) compares the contents of the memory digit address counter BL with preselected data and provides an output "1" if there is agreement. The comparator $V_1$ becomes operative either instruction 43 or 44 is developed. The data to be compared are derived from a gate $G_{26}$ which is an input gate to the comparator $V_1$. The data $n_2$ to be compared are specific higher address values which are often available in controlling the RAM. A comparison input gate $G_{26}$ provides $n_1$ and $n_2$ for comparison purposes upon the development of instructions 43 and 44, respectively.

An input gate $G_{27}$ is provided for the judgment F/F J to enter "1" into F/F J when the carry F/F C assumes "1" upon the development of instruction 45.

A decoder $DC_6$ decodes the operand $I_A$ and helps decide as to whether or not the content of a desired bit position of the RAM is "1". A gate $G_{28}$ transfers the contents of the RAM as specified by the operand decoder $DC_6$ into the judge F/F J when instruction 46 is derived. When the specified bit position of the RAM assumes "1", $J=1$. A comparator $V_2$ decides whether or not the contents of the accumulator ACC are equal to the operand $I_A$ and provides an output "1" when the affirmative answer is provided. The comparator $V_2$ becomes operative according to instruction 47. A comparator $V_3$ decides under instruction 48 whether the contents of the memory digit address counter BL are equal to the operand $I_A$ and provides an output "1" when the affirmative answer is obtained. A comparator $V_4$ decides whether the contents of the accumulator ACC agree with the contents of the RAM and provides an output "1" in the presence of the agreement. A gate $G_{29}$ transfers the fourth bit carry $C_4$ occurring during addition into the judge F/F J. Upon the development of instruction 50 $C_4$ is sent to F/F J. $J=1$ in the presence of $C_4$. A flage flip flop FA has an input gate $G_{31}$ which provides outputs "1" and "0" upon the development of instructions 52 and 53, respectively. An input gate $G_{32}$ is provided for setting the judge F/F J when the flag flip flop FA assumes "1". A flag flip flop $F_B$ also has an input gate $G_{33}$ which provides outputs "1" and "0" upon instructions 55 and 56, respectively. An input gate $G_{34}$ for the judge F/F J is adapted to transfer the contents of the flag flip flop $F_B$ into the F/F J upon the development of instruction 52. An input gate $G_{44}$ to the judge F/F J is enabled to transfer an input $\alpha$ in response to instruction 68. An input gate $G_{35}$ associated with the judge F/F J is provided for transmission of the contents of the input $\beta$ upon instruction 19. When $\beta=1$, $J=1$. An output gate $G_{45}$ from the accumulator ACC transfers the contents of the accumulator ACC to the data input/output terminals DIO of the display data storage DRM in response to instruction 73. An input gate $G_{35}$ associated with the input of the accumulator ACC is provided for transferring the output of the adder $AD_4$ upon instruction 26 and transferring the contents of the accumulator ACC after inverted via an inverter $IV_5$ upon instruction 27. The contents of the memory RAM are transferred upon instruction 28, the operand $I_A$ upon instruction 13, the 4 bit input contents $k_1$–$k_4$ upon instruction 57, the contents of the stack register SA upon instruction 59 and the data from the data storage DRM via DIO upon instruction 72. A stack register SA provides the output outside the present system. A stack register SC also provides the output outside the system. An input gate $G_{37}$ associated with the stack register SA transfers the contents of accumulator ACC upon instruction 58. An input gate $G_{38}$ associated with the stack register SX transfers the contents of the temporary register X upon instruction 58. A program stack register SP has an input gate $G_{39}$ for loading the contents of the program counter PL plus "1" through the adder into the program stack register, upon instruction 60.

An illustrative example of the instruction codes contained within the ROM of the CPU structure, the name and function of the instruction codes and the control instructions developed pursuant to the instruction codes will now be tabulated in Table 1 wherein A designates the instruction codes, B designates the instruction name, and D designates the CPU control instructions. The instruction descriptions are given in narrative sequence in the order of the instruction names B.

TABLE 1

| | A | B | D |
|---|---|---|---|
| 1 | $I_O$ | SKIP | 42 |
| 2 | $I_O$ | AD | 23, 26 |
| 3 | $I_O$ | ADC | 23, 26, 25, 1 |
| 4 | $I_O$ | ADCSK | 23, 26, 25, 50, 1 |
| 5 | $I_O$ $I_A$ | ADI | 24, 26, 50 |
| 6 | $I_O$ $I_A$ | DC | 24, 26, 50 |
| 7 | $I_O$ | SC | 21 |
| 8 | $I_O$ | RC | 22 |
| 9 | $I_O$ $I_A$ | SM | 2 |
| 10 | $I_O$ $I_A$ | RM | 3 |
| 11 | $I_O$ | COMA | 27 |
| 12 | $I_O$ $I_A$ | LDI | 13 |
| 13 | $I_O$ $I_A$ | L | 28, 8 |
| 14 | $I_O$ $I_A$ | LI | 28, 8, 15, 10, 43 |
| 15 | $I_O$ $I_A$ | XD | 28, 8, 14, 15, 10, 44 |
| 16 | $I_O$ $I_A$ | X | 28, 4, 8 |
| 17 | $I_O$ $I_A$ | XI | 28, 4, 8, 15, 10, 43 |
| 18 | $I_O$ $I_A$ | XD | 28, 4, 8, 14, 16, 10, 44 |
| 19 | $I_O$ $I_A$ | LBLI | 11 |
| 20 | $I_O$ $I_A$ $I_B$ | LB | 8, 12 |
| 21 | $I_O$ $I_A$ | ABLI | 16, 10, 43 |
| 22 | $I_O$ $I_A$ | ABMI | 6, 7 |
| 23 | $I_O$ $I_A$ | T | 20 |
| 24 | $I_O$ | SKC | 45 |
| 25 | $I_O$ $I_A$ | SKM | 46 |
| 26 | $I_O$ $I_A$ | SKBI | 48 |
| 27 | $I_O$ $I_A$ | SKAI | 47 |
| 28 | $I_O$ | SKAM | 49 |
| 29 | $I_O$ | $SKN_1$ | 36 |
| 30 | $I_O$ | $SKN_2$ | 37 |
| 31 | $I_O$ | $SKF_1$ | 38 |
| 32 | $I_O$ | $SKF_2$ | 39 |

TABLE 1-continued

| | A | B | D |
|---|---|---|---|
| 33 | $I_O$ | SKAK | 40 |
| 34 | $I_O$ | SKTAB | 41 |
| 35 | $I_O$ | SKFA | 51 |
| 36 | $I_O$ | SKFB | 54 |
| 37 | $I_O$ | WIS | 32 |
| 38 | $I_O$ | WIR | 33 |
| 39 | $I_O$ | NPS | 34 |
| 40 | $I_O$ | NPR | 35 |
| 41 | $I_O$ | ATF | 31 |
| 42 | $I_O$ | LXA | 29 |
| 43 | $I_O$ | XAX | 29, 30 |
| 44 | $I_O$ | SFA | 52 |
| 45 | $I_O$ | RFA | 53 |
| 46 | $I_O$ | SFB | 55 |
| 47 | $I_O$ | RFB | 56 |
| 48 | $I_O$ | SFC | 17 |
| 49 | $I_O$ | RFC | 18 |
| 50 | $I_O$ | SFD | 62 |
| 51 | $I_O$ | RFD | 63 |
| 52 | $I_O$ | SFE | 65 |
| 53 | $I_O$ | RFE | 66 |
| 54 | $I_O$ | SKA | 68 |
| 55 | $I_O$ | SKB | 19 |
| 56 | $I_O$ | KTA | 57 |
| 57 | $I_O$ | STPO | 58 |
| 58 | $I_O$ | EXPO | 58, 59 |
| 59 | $I_O$ $I_A$ | TML | 62, 20 |
| 60 | $I_O$ | RIT | 61 |
| 61 | $I_O$ $I_A$ $I_B$ | LNI | 69 |
| 62 | $I_O$ | READ | 70, 72 |
| 63 | $I_O$ | STOR | 71, 73 |
| 64 | $I_O$ $I_A$ | EX | 28, 4, 75, 16 |
| 65 | $I_O$ | DECB | 74 |

INSTRUCTION DESCRIPTION LISTED IN TABLE 1

SKIP: Only the program counter PL is incremented without executing a next program step instruction, thus skipping a program step.

AD: A binary addition is effected on the contents of the accumulator ACC and the contents of the RAM, the addition results being loaded back into the accumulator ACC.

ADC: A binary addition is effected on the contents of the accumulator ACC, the memory RAM and the carry F/F C, the results being loaded back to the accumulator ACC.

ADCSK: A binary addition is effected on the contents of the accumulator ACC, the memory RAM and the carry flip flop C, the results being loaded into the accumulator ACC. If the fourth bit carry $C_4$ occurs in the results, then a next program step is skipped.

ADI: A binary addition is achieved upon the contents of the accumulator ACC and the operand $I_A$ and the results are loaded into the accumulator ACC. If the fourth bit carry $C_4$ is developed in the addition results, then a next program step is skipped.

DC: The operand $I_A$ is fixed as "1010" (a decimal number "10") and a binary addition is effected on the contents of the accumulator ACC and the operand $I_A$ in the same way as in the ADI instruction. The decimal number 10 is added to the contents of the accumulator ACC, the results of the addition being loaded into ACC.

SC: The carry F/F C is set ("1" enters into C).

RC: The carry F/F C is reset ("0" enters into C).

SM: The contents of the operand $I_A$ are decoded to give access to a desired bit position of the memory specified by the operand ("1" enters).

RM: The contents of the operand $I_A$ are interpreted to reset a desired bit position of the memory specified by the operand ("0" enters).

COMA: The respective bits of the accumulator ACC are inverted and the resulting complement to "15" is introduced into ACC.

LDI: The operand $I_A$ enters into the accumulator ACC.

L: The contents of the memory RAM are sent to the accumulator ACC and the operand $I_A$ to the file address counter BM.

LI: The contents of the memory RAM are sent to the accumulator ACC and the operand $I_A$ to the memory file address counter BM. At this time the memory digit address counter BL is incremented. If the contents of BL agree with the preselected value $n_1$, then a next program step is skipped.

LD: The contents of the memory RAM are exchanged with the contents of ACC and the operand $I_A$ is sent to the memory file address counter BM. The memory digit address counter BL is decremented. In the event that the contents of BL agree with the preselected value $n_2$, then a next program step is skipped.

X: The contents of the memory RAM are exchanged with the contents of the accumulator ACC and the operand $I_A$ is loaded into the memory file address counter BM.

XI: The contents of the memory RAM are exchanged with the contents of the accumulator ACC and the operand $I_A$ is sent to the memory file address counter BM. The memory digit address counter BL is incremented. In the event that BL is equal to the preselected value $n_1$, a next program step is skipped.

XD: The contents of the memory RAM replaces the contents of the accumulator ACC, the operand $I_A$ being sent to the memory file address counter BM. The memory digit address counter BL at this time is incremented. If the contents of BL are equal to $n_2$, then a next program step is skipped.

LBLI: The operand $I_A$ is loaded into the memory digit address counter BL.

LB: The operand $I_A$ is loaded into the memory file address counter BM and the operand B to the memory digit address counter BL.

ABLI: The operand $I_A$ is added to the contents of the memory digit address counter BL in a binary addition fashion, the results being loaded back to BL. If the contents of BL are equal to $n_1$, then no next program step is carried out.

ABMI: The operand $I_A$ is added to the contents of the memory file address counter BM in a binary fashion, the results being into BM.

T: The operand $I_A$ is loaded into the program step counter PL.

SKC: If the carry flip flop C is "1", then no next program step is taken.

SKM: The contents of the operand $I_A$ are decoded and a next program step is skipped as long as a specific bit position of the memory specified by the operand $I_A$ assumes "1".

SKBI: The contents of the memory digit address counter BL are compared with the operand $I_A$ and a next succeeding program step is skipped when there is agreement.

SKAI: The contents of the accumulator ACC are compared with the operand $I_A$ and if both are equal to each other a next program step is skipped.

SKAM: The contents of the accumulator ACC are compared with the contents of the RAM and if both are equal a next program step is skipped.

$SKN_1$: When the input $KN_1$ is "0", a next program step is skipped.

$SKN_2$: When the input $KN_2$ is "0", a next program step is skipped.

$SKF_1$: When the input $KF_1$ is "0", a next program step is skipped.

$SKF_2$: When the input $KF_2$ is "0", a next program step is skipped.

SKAK: When the input AK is "1", a next program step is skipped.

SKTAB: When the input TAB is "1", a next program step is skipped.

SKFA: When the flag F/F F/A assumes "1" a next program step is skipped.

SKFB: When the flag F/F $F_B$ assumes "1", a next program step is skipped.

SKFD: When the flag F/F $F_D$ assumes "1", a next program step is skipped.

SKFE: When the flag F/F $F_E$ assumes "1", a next program step is skipped.

WIS: The contents of the output buffer register W are one bit right shifted, the first bit position (the most significant bit position) receiving "1".

WIR: The contents of the output buffer register W are one bit right shifted, the first bit position (the most significant bit position being loaded with "0").

NPS: The output control F/F $N_p$ for the buffer register W is set ("1" enters).

NPR: The buffer register output control flip flop $N_p$ is reset ("0" enters therein).

ATF: The contents of the accumulator ACC are transferred into the output buffer register F.

LXA: The contents of the accumulator ACC are unloaded into the temporary register X.

XAX: The contents of the accumulator ACC are exchanged with the contents of the temporary register X.

SFA: The flag F/F FA is set (an input of "1").

RFA: The flag F/F FA is reset (an input of "0").

SFB: The flag flip flop $F_B$ is set (an input of "1").

RFB: The flag flip flop $F_B$ is reset (an input of "0").

SFC: An input testing flag F/F $F_C$ is set (an input of "1").

RFC: The input testing flag F/F $F_C$ is reset (an input of "0").

SFD: The input testing flag F/F $F_D$ is set (an input of "1").

RFD: The input testing flag F/F $F_D$ is reset (an input of "0").

SFE: The input testing flag F/F $F_E$ is set (an input of "1").

RFE: The input testing flag F/F $F_E$ is reset (an input of "0").

SKA: When an input $\alpha$ is "1", a next program step is skipped.

SKB: When an input $\beta$ is "1", a next program step is skipped.

KTA: The inputs $k_1$–$k_4$ are introduced into the accumulator ACC.

STPO: The contents of the accumulator ACC are sent to the stack register SA and the contents of the temporary register X to the stack register SX.

EXPO: The contents of the accumulator ACC are exchanged with the stack register SA and the contents of the temporary register X with the stack register SX.

TML: The contents of the program counter $P_L$ incremented by one are transferred into the program stack register SP and the operand $I_A$ into the program counter $P_L$.

RIT: The contents of the program stack register SP are transmitted into the program counter $P_L$.

$LN_1$: The operands $I_A$ and $I_B$ enter the display and key input controlling flag F/Fs $N_1$ and $N_2$, respectively.

READ: Data externally applied to $D_{I/O}$ are introduced into the accumulator ACC.

STOR: The contents of the accumulator ACC are unloaded into $D_{I/O}$.

EX: The contents of the memory RAM are exchanged with that of the accumulator ACC and an exclusive-OR'ed output of the operand $I_A$ and the contents of the memory file address counter $B_M$ is supplied to $B_M$.

DECB: The memory digit address counter $B_L$ is decremented by "1". When the contents of $B_L$ are equal to the preset value $n_2$, a next instruction is skipped.

Table 2 sets forth the relationship between the operation codes contained within the ROM of the CPU structure and the operand.

TABLE 2

| | |
|---|---|
| AD → | $\overbrace{0001011000}^{I_O}$ |
| COMA → | $\overbrace{0001011111}^{I_O}$ |
| SKBI → | $\overbrace{0001}^{I_O}\overbrace{100010}^{I_A}$ |
| LB → | $\overbrace{01}^{I_O}\overbrace{0010101}^{I_A}\overbrace{011}^{I_B}$ → to $G_7$ → to $DC_5$ |

wherein $I_O$: the operation codes and $I_A$, $I_B$: the operands

Taking an example wherein the output of the read only memory ROM is 10 bit long, the instruction decoder $DC_5$ decides whether the instruction AD or COMA (see Table 1) assumes "0001011000" or "0001011111" and develops the control instructions 23, 26, or 27. SKBI is identified by the fact that the upper six bits assume "000110", the lower 4 bits "0010" being treated as the operand $I_A$ and the remaining ninth and tenth bits "11" as the operand $I_B$. The operand forms part of instruction words and specifies data and addresses for next succeeding instructions and can be called an address area of an instruction.

Major processing operations (a processing list) of the CPU structure will now be described in sufficient detail.

[PROCESSING LIST]

(I) A same numeral N is loaded into a specific region of the memory RAM (NNN→X)

(II) A predetermined number of different numerals are loaded into a specific region of the memory ($N_1$, $N_2$, $N_3$, . . . →X)

(III) The contents of a specific region of the memory are transferred into a different region of the memory (X→Y)

(IV) The contents of a specific region of the memory are exchanged with that of a different region (X⟷Y)

(V) A given numeral N is added or subtracted in a binary fashion from the contents of a specific region of the memory (X±N)

(VI) The contents of a specific region of the memory are added in a decimal fashion to the contents of a different region (X±Y)

(VII) The contents of a specific region of the memory are one digit shifted (X right, X left).

(VIII) A one bit conditional F/F associated with a specific region of the memory is set or reset (F set, F reset) (IX) The state of the one bit conditional F/F associated with a specific region of the memory is sensed and a next succeeding program address is changed according to the results of the state detection.

(X) It is decided whether the digit contents of a specific region of the memory reach a preselected numeral and a next succeeding program step is altered according to the results of such decision.

(XI) It is decided whether the plural digit contents of a specific region of the memory are equal to a preselected numeral and a program step is altered according to the results of the decision.

(XII) It is decided whether the digit contents of a specific region of the memory are smaller than a given value and a program step to be next executed is changed according to the decision.

(XIII) It is decided whether the contents of a specific region of the memory are greater than a given value and the results of such decision alter a program step to be next executed.

(XIV) The contents of a specific region of the memory are displayed. (XV) What kind of a key switch is actuated is decided.

(XVI) The external memory is shifted digit by digit within the same memory file address.

The above processing events in (I)-(XVI) above are executed according to the instruction codes step by step in the following manner.

(I) PROCEDURE OF LOADING A SAME VALUE A INTO A SPECIFIC REGION OF THE MEMORY (NNN→X)

(Type 1)

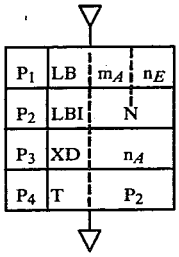

P: Step (Type 2)

-continued

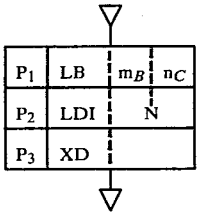

(Type 3)

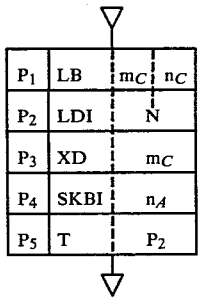

(II) PROCEDURE OF LOADING A PREDETERMINED NUMBER OF DIFFERENT VALUES INTO A SPECIFIC REGION OF THE MEMORY ($N_1$, $N_2$, $N_3$, . . . →X)

(Type 1)

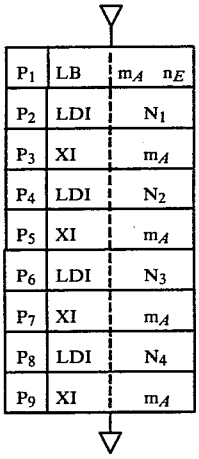

(Type 2)

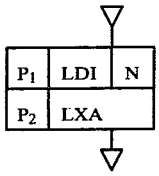

(III) PROCEDURE OF TRANSFERRING THE CONTENTS OF A SPECIFIC REGION OF THE MEMORY TO A DIFFERENT REGION OF THE MEMORY (X→Y)

(Type 1)

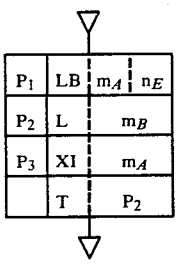

(Type 2)

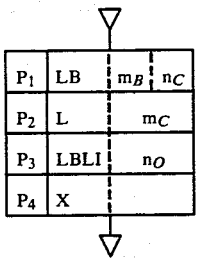

(Type 3)

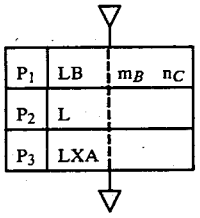

(Type 4)

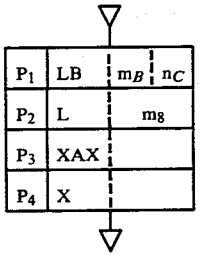

(IV) PROCEDURE OF EXCHANGING CONTENTS BETWEEN A SPECIFIC REGION OF THE MEMORY AND A DIFFERENCE REGION (X→Y)

(Type 1)

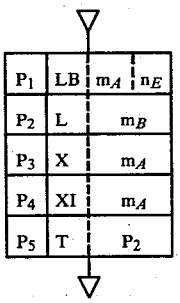

(Type 2)

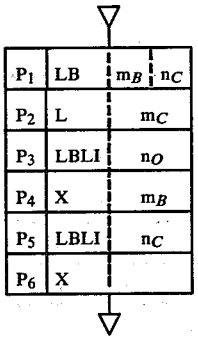

(Type 3)

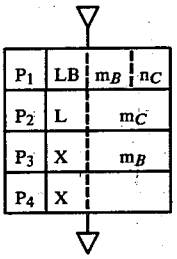

(V) PROCEDURE OF EFFECTING A BINARY ADDITION OR SUBTRACTION OF A GIVEN VALUE N ONTO A SPECIFIC REGION OF THE MEMORY (Type 1) $M_1 + N \longrightarrow M$ -continued

| | | | |
|---|---|---|---|
| $P_1$ | LB | $m_B$ | $n_C$ |
| $P_2$ | L | $m_B$ | |
| $P_3$ | ADI | N | |
| $P_4$ | X | | |

(Type 2) X + N ⟶ X

| | | | |
|---|---|---|---|
| $P_1$ | XAX | | |
| $P_2$ | ADI | N | |
| $P_3$ | XAX | | |

(Type 3) $M_1$ + N ⟶ $M_2$

| | | | |
|---|---|---|---|
| $P_1$ | LB | $m_B$ | $n_C$ |
| $P_2$ | L | $m_C$ | |
| $P_3$ | ADI | N | |
| $P_4$ | X | | |

(Type 4) $M_1$ − N ⟶ $M_1$

| | | | |
|---|---|---|---|
| $P_1$ | LB | $m_B$ | $n_C$ |
| $P_2$ | SC | | |
| $P_3$ | LDI | N | |
| $P_4$ | COMA | | |
| $P_5$ | ADC | | |
| $P_6$ | X | | |

(Type 5) $M_1$ − N ⟶ $M_2$

-continued

| | | | |
|---|---|---|---|
| $P_1$ | LB | $m_B$ | $n_C$ |
| $P_2$ | SC | | |
| $P_3$ | LDI | N | |
| $P_4$ | COMA | | |
| $P_5$ | ADC | | |
| $P_6$ | LB | $m_C$ | $n_C$ |
| $P_7$ | X | | |

same as Type 4

(Type 6)

| | | | |
|---|---|---|---|
| $P_1$ | LB | $m_B$ | $n_C$ |
| $P_2$ | SC | | |
| $P_3$ | LDI | N | |
| $P_4$ | COMA | | |
| $P_5$ | X | $m_B$ | |
| $P_6$ | XAX | | |
| $P_7$ | ADC | | |
| $P_8$ | EXAX | | |

(Type 7) N − $M_1$ ⟶ $M_1$

| | | | |
|---|---|---|---|
| $P_1$ | LB | $m_B$ | $n_C$ |
| $P_2$ | SC | | |
| $P_3$ | LDI | N | |
| $P_4$ | X | $m_B$ | |
| $P_5$ | COMA | | |
| $P_6$ | ADC | | |
| $P_7$ | X | | |

(Type 8) N − $M_1$ ⟶ $M_2$

-continued

| | | | |
|---|---|---|---|
| $P_1$ | LB | $m_B$ | $n_C$ |
| $P_2$ | L | $m_C$ | |
| $P_3$ | COMA | | |
| $P_4$ | ADI | N + 1 | |
| $P_5$ | X | | |

(Type 9) $M \pm M \longrightarrow M_2$

| | | | |
|---|---|---|---|
| $P_1$ | LDI | 1 | |
| $P_{1'}$ | LDI | F | |
| $P_2$ | LB | $m_B$ | $n_C$ |
| $P_3$ | AD | | |
| $P_4$ | X | | |

(VI) PROCEDURE OF EFFECTING A DECIMAL ADDITION OR SUBTRACTION BETWEEN A SPECIFIC REGION OF THE MEMORY AND A DIFFERENT REGION (Type 1) $X + W \longrightarrow X$

| | | | |
|---|---|---|---|
| $P_1$ | LB | $m_A$ | $n_E$ |
| $P_2$ | RC | | |
| $P_3$ | L | $m_B$ | |
| $P_4$ | ADI | 6 | |
| $P_5$ | ADCSK | | |
| $P_6$ | DC | | |
| $P_7$ | XI | $m_A$ | |
| $P_8$ | T | $P_3$ | |

(Type 2) $X - W \longrightarrow X$

-continued

| | | | |
|---|---|---|---|
| $P_1$ | LB | $m_A$ | $n_E$ |
| $P_2$ | SC | | |
| $P_3$ | L | $m_B$ | |
| $P_4$ | COMA | | |
| $P_5$ | ADCSK | | |
| $P_6$ | DC | | |
| $P_7$ | XI | $m_A$ | |
| $P_8$ | T | $P_3$ | |

(VII) PROCEDURE OF SHIFTING ONE DIGIT THE CONTENTS OF A SPECIFIC REGION OF THE MEMORY (Type 1) Right Shift

| | | | |
|---|---|---|---|
| $P_1$ | LB | $m_A$ | $n_A$ |
| $P_2$ | LDI | O | |
| $P_3$ | XD | $m_A$ | |
| $P_4$ | T | $P_3$ | |

(Type 2) Left Shift

| | | | |
|---|---|---|---|
| $P_1$ | LB | $m_A$ | $n_E$ |
| $P_2$ | LDI | O | |
| $P_3$ | XI | $m_A$ | |
| $P_4$ | T | $P_3$ | |

(VIII) PROCEDURE OF SETTING OR RESETTING A ONE-BIT CONDITION F/F ASSOCIATED WITH A SPECIFIC REGION OF THE MEMORY (Type 1)

| | | | |
|---|---|---|---|
| $P_1$ | LB | $m_A$ | $n_C$ |
| $P_2$ | SM | N | |

(Type 2)

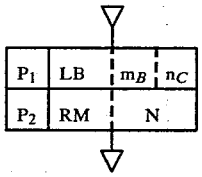

(IX) PROCEDURE OF SENSING THE STATE OF THE ONE-BIT CONDITIONAL F/F ASSOCIATED WITH A SPECIFIC REGION OF THE MEMORY AND CHANGING A NEXT PROGRAM ADDRESS (STEP) AS A RESULT OF THE SENSING OPERATION

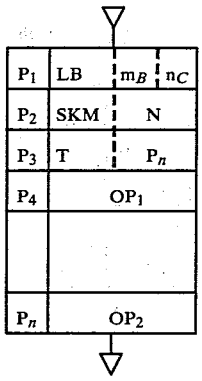

(X) PROCEDURE OF DECIDING WHETHER THE DIGIT CONTENTS OF A SPECIFIC REGION OF THE MEMORY REACH A PRESELECTED NUMERAL AND ALTERING A NEXT PROGRAM ADDRESS (STEP) ACCORDING TO THE RESULTS OF THE DECISION

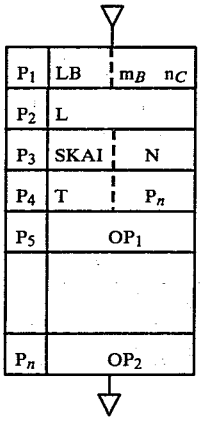

(XI) PROCEDURE OF DECIDING WHETHER THE PLURAL DIGIT CONTENTS OF A SPECIFIC REGION OF THE MEMORY ARE EQUAL TO A PRESELECTED NUMERAL AND ALTERING A PROGRAM STEP ACCORDING TO THE RESULTS OF THE DECISION

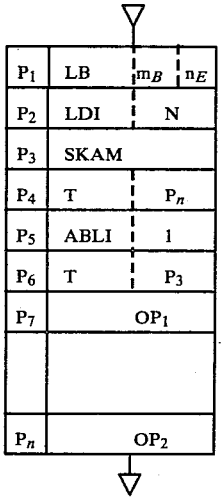

(XII) PROCEDURE OF DECIDING WHETHER THE CONTENTS OF A SPECIFIC REGION OF THE MEMORY ARE SMALLER THAN A GIVEN VALUE AND DECIDING WHICH ADDRESS (STEP) IS TO BE EXECUTED

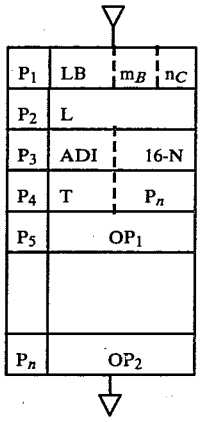

(XIII) PROCEDURE OF DECIDING WHETHER THE CONTENTS OF A SPECIFIC REGION OF THE MEMORY ARE GREATER THAN A GIVEN VALUE AND DECIDING WHICH ADDRESS (STEP) IS TO BE EXECUTED

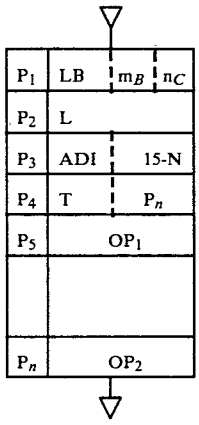

(XIV) PROCEDURE OF DISPLAYING THE CONTENTS OF A SPECIFIC REGION OF THE MEMORY (Type 1)

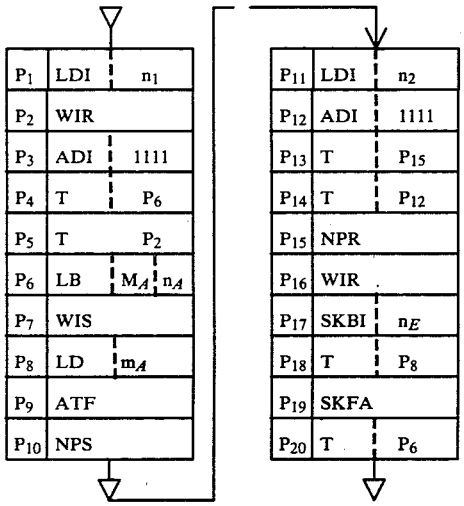

$P_1$ . . . The bit number $n_1$ of the buffer register W is loaded into ACC to reset the overall contents of the buffer register W for generating digit selection signals effective to drive a display panel on a time sharing basis.

$P_2$ . . . After the overall contents of the register W are one bit shifted to the right, its first bit is loaded with "0". This procedure is repeated via $P_4$ until $C_4=1$ during $P_3$, thus resetting the overall contents of W.

$P_3$ . . . The operand $I_A$ is decided as "1111" and AC+1111 is effected (this substantially corresponds to ACC−1). Since ACC is loaded with $n_1$ during $P_1$, this process is repeated $n_1$ times. When the addition of "1111" is effected following ACC=0, the fourth bit carry $C_4$ assumes "0". When this occurs, the step is advanced to $P_4$. Otherwise the step is skipped up to $P_5$.

$P_4$ . . . When the fourth bit carry $C_4=0$ during ACC+1111, the overall contents of W are reduced to "0" to thereby complete all the pre-display processes. The first address $P_6$ is set for the memory display steps.

$P_5$ . . . In the event that the fourth bit carry $C_4=1$ during ACC+1111, the overall contents of W have not yet reduced to "0". Under these circumstances $P_2$ is reverted to repeat the introduction of "0" into W.

$P_6$ . . . The first digit position of the memory region which contains data to be displayed is identified by the file address $m_A$ and the digit address $n_A$.

$P_7$ . . . After the contents of the register W for generating the digit selection signals are one bit shifted to the right, its first bit position is loaded with "1" and thus ready to supply the digit selection signal to the first digit position of the display.

$P_8$ . . . The contents of the specific region of the memory are unloaded into ACC. The file address of the memory still remains at $m_A$, whereas the digit address is decremented for the next succeeding digit processing.

$P_9$ . . . The contents of the memory is shifted from ACC to the buffer register F. The contents of the register F are supplied to the segment decoder SD to generate segment display signals.

$P_{10}$ . . . To lead out the contents of the register W as display signals, the conditional F/F $N_p$ is supplied with "1" and placed into the set state. As a result of this, the contents of the memory processed during $P_9$ are displayed on the first digit position of the display.

$P_{11}$ . . . A count initial value $n_2$ is loaded into ACC to determine a one digit long display period of time.

$P_{12}$ . . . ACC-1 is carried out like $P_3$. When ACC does not assume "0" (when $C_4=1$) the step is skipped up to $P_{14}$.

$P_{13}$ . . . A desired period of display is determined by counting the contents of ACC during $P_{12}$. After the completion of the counting $P_{15}$ is reached from $P_{13}$. The counting period is equal in length to a one-digit display period of time.

$P_{14}$ . . . Before the passage of the desired period of display the step is progressed from $P_{12}$ to $P_{14}$ with skipping $P_{13}$ and jumped back to $P_{12}$. This procedure is repeated.

$P_{15}$ . . . $N_p$ is reset to stop supplying the digit selection signals to the display. Until $N_p$ is set again during $P_{10}$, overlapping display problems are avoided by using the adjacent digit signals.

$P_{16}$ . . . The register W is one bit shifted to the right and its first bit position is loaded with "0". "1" introduced during $P_7$ is one bit shifted down for preparation of the next succeeding digit selection.

$P_{17}$ . . . It is decided whether the ultimate digit of the memory to be displayed has been processed and actually whether the value $n_E$ of the last second digit has been reached because the step $P_8$ of $B_L-1$ is in effect.

$P_{18}$ . . . In the event that ultimate digit has not yet been reached, $P_8$ is reverted for the next succeeding digit display processing.

$P_{19}$ . . . For example, provided that the completion of the display operation is conditional by the flag F/F FA, FA=1 allows $P_{20}$ to be skipped, thereby concluding all the displaying steps.

$P_{20}$ . . . If FA=1 at $P_{19}$, the display steps are reopened from the first display and the step is jumped up to $P_6$.

(Type 2)

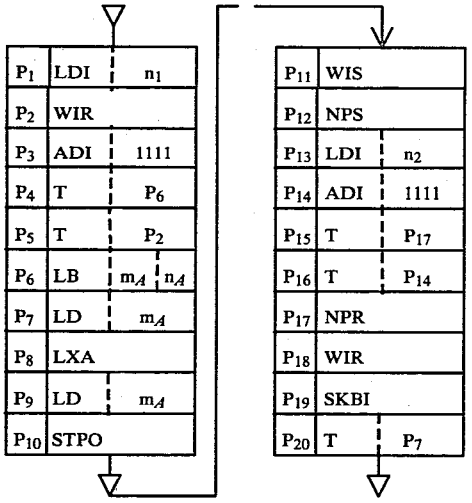

$P_1$ . . . The bit number $n_1$ of the buffer register W is loaded into ACC to reset the overall contents of the buffer register W for generating digit selection signals effective to drive a display panel on a time sharing basis.

$P_2$ . . . After the overall contents of the register W are one bit shifted to the right, its first bit is loaded with "0". This procedure is repeated via $P_4$ until $C_4=1$ during $P_3$, thus resetting the overall contents of W.

$P_3$ . . . The operand $I_A$ is decided as "1111" and AC+1111 is effected (this substantially corresponds to ACC-1). Since ACC is loaded with $n_1$ during $P_1$, this process is repeated $n_1$ times. When the addition of "1111" is effected following ACC=0, the fourth bit carry $C_4$ assumes "0". When this occurs, the step is advanced to $P_4$. Otherwise the step skipped up to $P_5$.

$P_4$ . . . When the fourth bit carry $C_4=0$ during ACC+1111, the overall contents of W are reduced to "0" to thereby complete all the pre-display processes. The first address $P_6$ is set for the memory display steps.

$P_5$ . . . In the event that the fourth bit carry $C_4=1$ during ACC+1111, the overall contents of W have not yet reduced to "0". Under these circumstances $P_2$ is reverted to repeat the introduction of "0" into W.

$P_6$ . . . The upper four bits of the first digit position of the memory region which contains data to be displayed are identified by the file address $m_A$ and the digit address $m_A$.

$P_7$ . . . The contents of the specific region of the memory are unloaded into ACC. The file address of the memory still remains at $m_A$, whereas the digit address is decremented to specify the lower four bits.

$P_8$ . . . The contents of ACC, the upper four bits, are transmitted into the temporary register X.

$P_9$ . . . The contents of the specific region of the memory are unloaded into ACC. The file address of the memory still remains at $m_A$, whereas the digit address is decremented to specify the upper four bits of the next succeeding digit.

$P_{10}$ . . . The contents of ACC are unloaded into the stack register SA and the contents of the temporary register X into the stack register SX.

$P_{11}$ . . . After the contents of the register W for generating the digit selection signals are one bit shifted to the right, its first bit position is loaded with "1" and thus ready to supply the digit selection signal to the first digit position of the display.

$P_{12}$ . . . To lead out the contents of the register W as display signals, the conditional F/F $N_p$ is supplied with "1" and placed into the set state. As a result of this, the contents of the memory processed during $P_{10}$ are displayed on the first digit position of the display.

$P_{13}$ . . . A count initial value $n_2$ is loaded into ACC to determine a one digit long display period of time.

$P_{14}$ . . . ACC−1 is carried out like $P_3$. When ACC assumes "0" $P_{15}$ is reached and when ACC≠0 (when $C_4=1$) the step is skipped up to $P_{16}$. This procedure is repeated.

$P_{15}$ . . . A desired period of display is determined by counting the contents of ACC during $P_{14}$. After the completion of the counting $P_{17}$ is reached from $P_{15}$. The counting period is equal in length to a one-digit display period of time.

$P_{16}$ . . . Before the passage of the desired period of display the step is progressed from $P_{14}$ to $P_{16}$ with skipping $P_{15}$ and jumped back to $P_{14}$. This procedure is repeated.

$P_{17}$ . . . $N_p$ is reset to stop supplying the digit selection signals to the display. Until $N_p$ is set again during $P_{10}$, overlapping display problems are avoided by using the adjacent digit signals.

$P_{18}$ . . . The register W is one bit shifted to the right and its first bit position is loaded with "0". "1" introduced during $P_7$ is one bit shifted down for preparation of the next succeeding digit selection.

$P_{19}$ . . . It is decided whether the ultimate digit of the memory to be displayed has been processed and actually whether the value $n_E$ of the last second digit has been reached because the step $p_9$ of $B_L-1$ is in effect.

$P_{20}$ . . . In the event that ultimate digit has not yet been reached, $P_7$ is reverted for the next succeeding digit display processing.

(XV) PROCEDURE OF DECIDING WHICH KEY SWITCH IS ACTUATED (SENSING ACTUATION OF ANY KEY DURING DISPLAY)

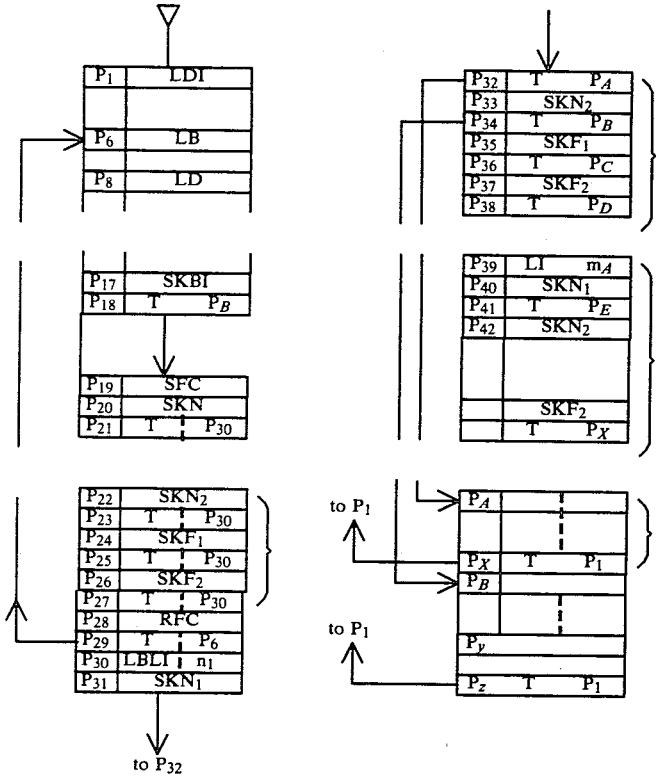

$P_1$–$P_{18}$ . . . The display processes as discussed in (XIV) above.

$P_{19}$ . . . After the overall digit contents of the register W are displayed, the flag F/F FC is set to hold all the key signals $I_1$–$I_n$ at a "1" level.

$P_{20}$ . . . The step is jumped to $P_{30}$ as long as any one of the keys connected to the key input $KN_1$ is actuated.

$P_{22}$–$P_{27}$ . . . It is decided whether any one of the keys each connected to the respective key inputs $KN_2$–$KF_2$ and in the absence of any actuation the step is advanced toward the next succeeding step. To the contrary, the presence of the key actuation leads to $P_{30}$.

$P_{28}$ . . . When any key is not actuated, F/F FC is reset to thereby complete the decision as to the key actuations.

$P_{29}$ . . . The step is jumped up to $P_6$ to reopen the display routine.

$P_{30}$ . . . When any key is actually actuated, the memory digit address is set at $n_1$ to generate the first key strobe signal $I_1$.

$P_{31}$ . . . It is decided if the first key storbe signal $I_1$ is applied to the key input $KN_1$ and if not the step is advanced toward $P_{33}$.

$P_{32}$ . . . When the first key strobe signal $I_1$ is applied to the key input $KN_1$, which kind of the keys is actuated is decided. Thereafter, the step is jumped to $P_A$ to provide proper controls according to the key decision. After the completion of the key decision the step is returned directly to $P_1$ to commence the displaying operation again ($P_Z$ is to jump the step to $P_1$)

$P_{33}$–$P_{38}$ . . . It is sequentially decided whether the keys coupled with the first key strobe signal $I_1$ are actuated. If a specific key is actuated, the step jumps to $P_B$–$P_D$ for providing appropriate controls for that keys.

$P_{39}$ . . . This step is executed when no key coupled.

(XVI) PROCEDURE OF SHIFTING THE EXTERNAL MEMORY DIGIT BY DIGIT WITHIN THE SAME MEMORY FILE ADDRESS

| | | | |
|---|---|---|---|
| $P_1$ | LB | | mA −nE |
| $P_2$ | | LXA | |
| $P_3$ | | READ | |
| $P_4$ | | XAX | |
| $P_5$ | | STOR | |
| $P_6$ | | XAX | |
| $P_7$ | | DECB | |
| $P_8$ | T | | $P_2$ |

$P_1$ . . . The file address $m_A$ and the digit address $n_E$ of the memory step $P_5$ are selected.

$P_2$ . . . The contents of the accumulator ACC are loaded in the register X for the time being.

$P_3$ . . . ACC is loaded with the contents specified at the step $P_1$.

$P_4$ . . . The contents of the register X set all during the step $P_2$ are returned to the accumulator ACC through exchange between the both.

$P_5$ . . . The memory as specified by $P_1$ is loaded with the contents of ACC.

$P_6$ . . . The contents of the register X are transmitted into ACC through the exchange process.

$P_7$ . . . The digit address counter is decremented. By defining the final digit value as "$n_2$" the file selected at the step $n_2$ is shifted as a whole shifted.

$P_8$ . . . The program address is set at the step $P_2$ and the steps $P_2$–$P_7$ are repeatedly executed until $BL=n_2$.

The foregoing is the description of the respective major processing events in the CPU architecture.

Figure 6:
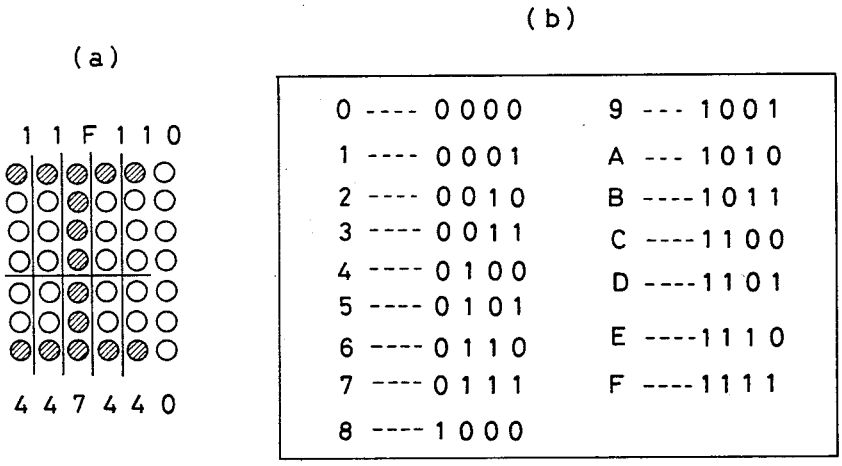
FIG. 6 is a view showing an example of a dot matrix display pattern on a display panel according to the present invention.

By reference to FIG. 6 an example of the display operation implementing the present invention will now be described in detail. For example, if the displaying of a character "I" is desired, the display panel for each digit being a 7×5 dot matrix is divided into an upper half and a lower half and encoded information is defined as "11F1144744" in the descending order. This is accomplished by sending selected ones of the segment signals s1–s126 and selected ones of the opposite electrode signals h1–h7 to dot positions necessary for the displaying of the character "I". As indicated in FIG. 5(*b*), each digit 0, 1, 2, . . . 9, A, B, . . . F of the encoded information consists of their unique combination of 4 bits. The enabling waveform signals and disabling waveform signals are provided when the respective bits have "1" and "0", respectively.

Figure 7:
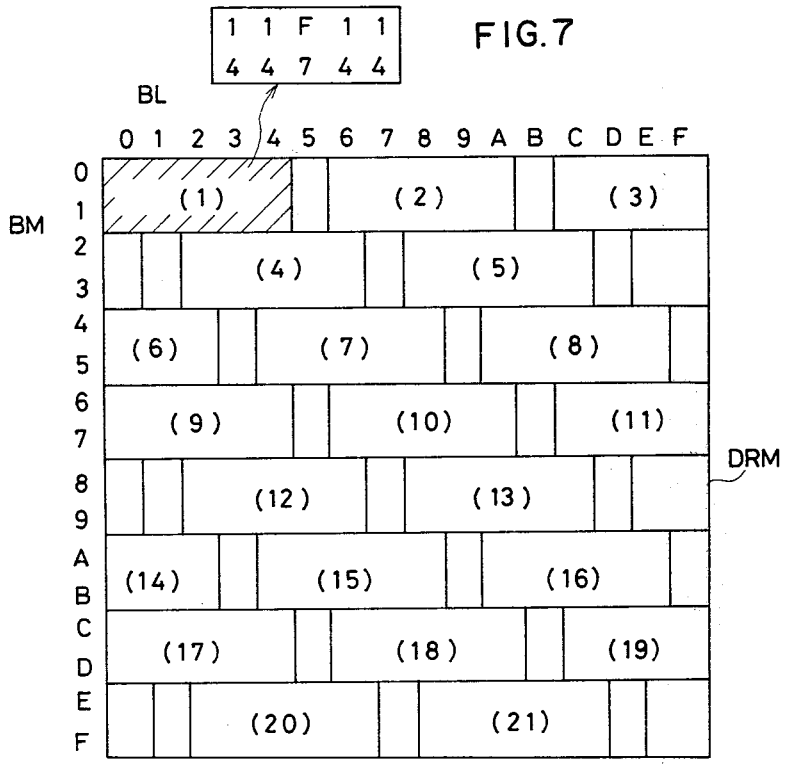
FIG. 7 is a view for explanation of a storage area in a display data memory.

The display data storage section DRM as shown in FIG. 7 is to temporarily store those display encoded data. The respective segments (1)–(21) store independently the encoded information characteristic of characters to be displayed. In the illustrated example, the segment (1) stores the encoded information "11F1144744" associated with the character "I".

The display data storage section DRM has a 21 digit capacity. The display regions 1–21 of the display data storage DRM correspond to the respective display digits of the display panel DSP and constitute the first storage means of FIG. 1. The information of multiple words introduced via the keyboard K is stored within the external memory $MU_1$ and is shifted sequentially through the display regions 1, 2, 3, 4 . . . . The display data in the display regions 1–21 are visually displayed on the display panel DSP.

FIG. 7 is a typical information display state according to one embodiment of the present invention. For example, if it is desired to display information "MAY I ASK YOU TO POST THIS LETTER?", this sentence is displayed word by word on the 21-digit display panel. First of all, information "MAY I ASK YOU TO POST" is displayed for a given interval of time as depicted in FIG. 8(1). The display panel is then left-shifted by the number of characters to be next displayed, i.e., 5 digits so that the lowest (last) 5 digit positions of the display panel DSP are blank as shown in FIG. 8(2). Upon the completion of the shift operation "THIS" is inserted into the blank digit positions as in FIG. 8(3). Similarly, the display panel is left-shifted by the number of the next succeeding character "LETTER" so that the lowest (last) 7 digits are blank. "LETTER" is displayed on the blank digit positions after the shift operation. In order to display "?" behind "LETTER", the display panel is left-shifted by two characters to locate "?" thereat.

Figure 9:
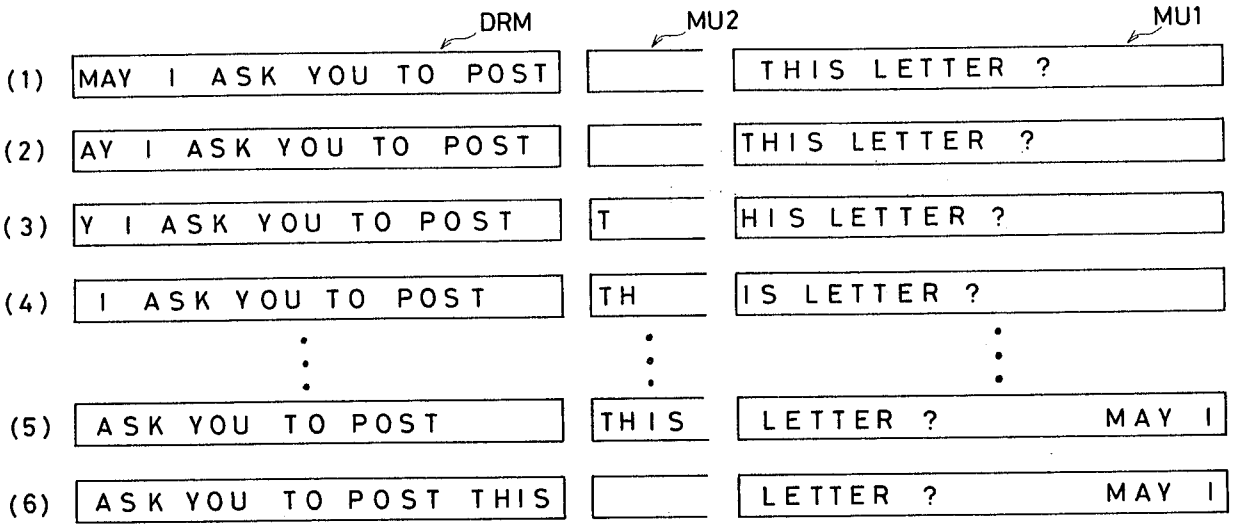
FIG. 9 is an illustration of operation by which information contained in an external memory is transferred into the display data memory in the preferred embodiment of the present invention.
Figure 10:
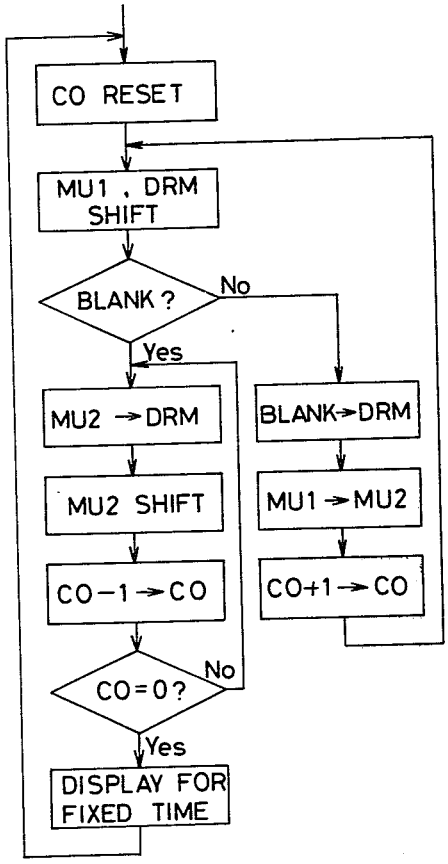
FIG. 10 is a flow chart of a particular operation according to the preferred embodiment of the present invention.
Figure 11:
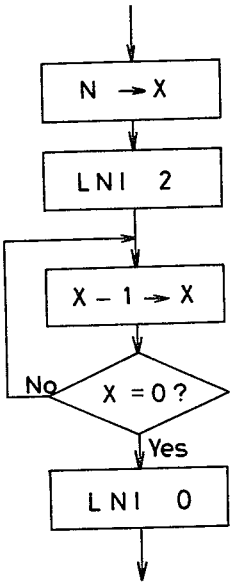
FIG. 11 is a flow chart of the subroutine of display for a limited period of time as shown in FIG. 10.
Figure 12:
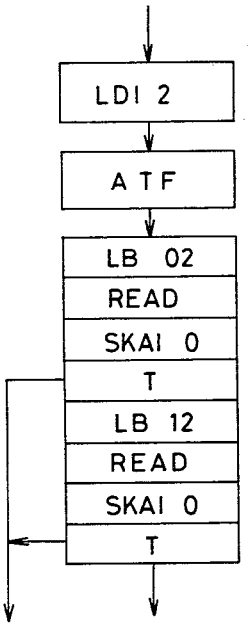
FIG. 12 is a flow chart of the subroutine of blank decision in FIG. 10.

FIG. 9 is an illustration of operation according to the illustrated embodiment of the present invention by which information is unloaded from the external memory to the display data storage. FIG. 10 is a flow chart of explanation of a specific display control operation according to the illustrated embodiment of the present invention. FIG. 11 is a flow chart showing a subroutine for limited time display in FIG. 10. FIG. 12 is a flow chart of a subroutine for blank decision steps in FIG. 10.

The illustrated embodiment of the present invention operates in the following manner as is clear in FIGS. 1 through 12. The display data storage DRM contains the information "MAY I ASK YOU TO POST" as indicated in FIG. 9(1), while the external memory $MU_1$ contains "THIS LETTER?" The counter CO in a particular region of the RAM of the CPU scheme of FIG. 4A is first reset. While the information in the external memory $MU_1$ is shifted into the external memory $MU_2$, the counter CO counts the number of such shifts and in other words the number of characters in the word being shifted from the external memory $MU_1$ to the other external memory $MU_2$. After the counter CO is reset, the contents of the external memory $MU_1$ are shifted to the left by a character and at the same time the contents of the display data storage DRM are left-shifted by a single character. It is decided whether the most significant bit of the external memory $MU_1$ contains a blank code indicative of the boundaries of words. If the leading character from the external memory $MU_1$ is blank, then the blank code is sent to the display control circuit DRM. The leading character "T" of the next information "THIS" to be displayed is sent to the external memory $MU_2$. The counter CO is incremented.

The contents of the external memory $MU_1$ and the display data storage DRM are shifted to the left by a character. The following step is a decision as to whether the leading character of the external memory $MU_1$ is blank. If not, the next character "H" is transferred into the external memory $MU_2$ and the counter CO is incremented. This procedure is repeated to place the next information into the external memory $MU_2$ in succession. Simultaneously, the contents of the display data storage DRM are left-shifted by the number of the characters in "THIS" (i.e., 40) plus a space (a total of 5 characters). When "THIS" is fetched, the most significant bit of the external memory $MU_1$ becomes blank. If the CPU senses this blank position, then the contents of the external memory $MU_2$ are shifted word by word to the display data storage DRM. Each time a character is transferred, the counter CO is decremented until its count reduces to "0". When the count of the counter CO reaches "0", the contents of the display data storage DRM are displayed on the display panel DSP for a limited period of time.

It is noted that the respective steps in FIG. 10 may be achieved by respective ones of the above defined processing list. For example, "CO reset" and "blank DRM" are achieved by processing list (II), "MU2→DRM" and "MU1→MU2" by type (4) of list (III), "CO=0?" by list (X), "CO−1→CO" and "CO+1→CO", by list (V) or (VI), "MU1, DRM shift" and "MU2 shift" by list (XXII).

The limited time display is performed pursuant to the subroutine of FIG. 11. A value N indicative of the limited interval of time is introduced into a particular region of the CPU scheme. The display control signal DIS is supplied to the segment decoder SED of the display control circuit DSC. Furthermore, the contents of the storage region X of the RAM are decremented until they reduce to "0". If the contents of the storage region X are "0", then the display control signal DIS is interrupted to discontinue display operation. In the subroutine of FIG. 11, the steps "N→X", "X−1→X" and "X=0?" are performed by processing lists (II), (V) and (X), respectively.

The blank decision step may be achieved by the subroutine of FIG. 12. In the given example, this is accomplished by deciding if the BM and BL addresses 02 and 12 of the display data storage DRM contain "0". These regions contain data corresponding to the longitudinal, center 7 dots of the most significant digit position of the display panel DSP when they are next shifted. Any character defined by 5×7 dots is displayed by energizing any of the 7 dots except for special symbols. Based upon this fact, any blank digit position can be determined by deciding if the longitudinal, center 7 dots in the 5×7 dot matrix are in a disabled state.

Figure 14:
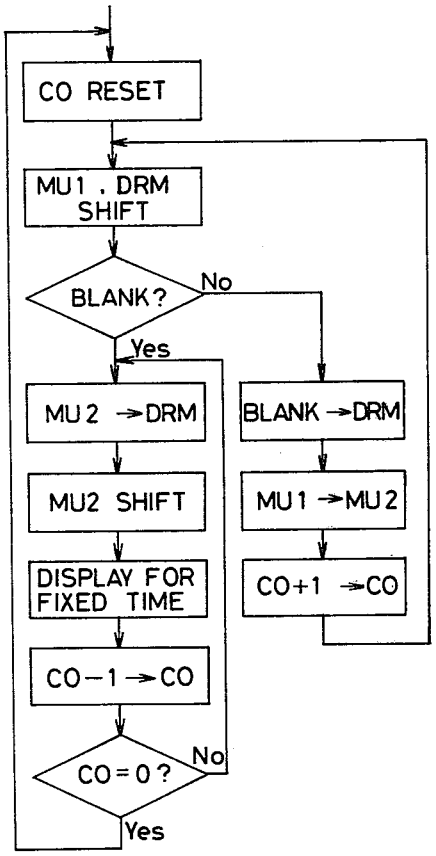
FIG. 14 is a flow chart showing a particular operation in the last embodiment of the present invention.

FIG. 13 is an illustration of operation by which the information in the external memory is transferred into the display data storage according to another embodiment of the present invention and FIG. 14 is a flow chart showing a particular operation according to the second embodiment of the present invention.

The following will set forth the second embodiment of the present invention by reference to FIGS. 1 through 7, FIG. 9 and FIGS. 11 through 14. The second embodiment is adapted such that, when the blank digit position is about to display the next succeeding word, that word is displayed character by character as illustrated in FIG. 13.

Operation of the second embodiment is substantially similar to that in FIG. 10 except for the following aspects. The contents of the external memory $MU_1$ containing the next succeeding word to be displayed are fetched therefrom character to character and loaded into the external memory $MU_2$. The contents of the display data storage DRM are correspondingly left-shifted by the number of those characters. If the blank code enters the most significant bit of the external memory $MU_1$, the shift operation is interrupted on the display data storage DRM and "T" at the most significant bit of the external memory $MU_2$ is shifted to the fourth least significant bit of the display data storage DRM. Upon the passage of the limited period of time the counter CO is decremented. The next succeeding character "H" is transferred from the external memory $MU_2$ to the display data storage DRM. The above procedure is repeated until the count of the counter CO reaches "0". The result is that the lowest five digit positions of the display panel DSP are blank and only "T" of the next word "THIS" is displayed, followed by a succession of "H", "I" and "S". Consequently, the contents of display are emphasized by displaying the next word sequentially from character to character.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An information display for displaying information messages such as sentences and data whose units are groups of characters defining words, comprising:

display means having a certain digit capacity for displaying selected portions of an information message;

information source means for supplying said information;

first storage means including first and second memory means for receiving and storing said information from said information source means with interposition of at least one specific signal defining a blank between each adjacent word;

second storage means having specific storage regions corresponding to the respective digits of said display means for sequentially receiving an initial portion of said information message corresponding to that number of digits and the balance of said information thereafter in a word by word sequence;

means for fetching said initial portion and said balance of said information from said first storage means and sequentially presenting same to said second storage means character by character; and control means responsive to the number of characters in each said word of said balance of information for constraining specific digit positions to be provided by said display means beginning with one side thereof and corresponding to the number of said characters in said word and to its position in said message to be first unoccupied and then filled with a complete word of said information from said second storage means and shifting the initial portion and previously displayed words from said balance of said message to provide said specific digit positions for each successive word to be displayed until said message has been displayed in full by said display means;

said first memory means initially containing said information message and said second memory means being interconnected between said first memory means and said second storage means; and said control means further including counting means responsive to the number of characters in each said characters in each said word in the balance of said information message transferred from said first memory means to said second memory means for determining the number of specific digit positions required by each such word on said display means.

2. The information display according to claim 1, wherein said counting means is responsive to the occurrence of a said blank signal at the end of each said word in said first memory means in the balance of said information message to preclude transfer of that said blank signal to said second memory means and preclude said control means from constraining said display means to provide more specific digit positions for that word.

3. An information display according to claims 1 or 2 wherein said control means further constrains the specific digit positions provided by said display means to be filled simultaneously with all the characters of a said word from the balance of said message.

4. An information display according to claims 1 or 2 wherein said control means further constrains the specific previously unoccupied digit portions provided by said display means to be filled in a selected character by character sequence.

* * * * *